United States Patent [19]

Murdock

[11] 4,136,856

[45] Jan. 30, 1979

[54] SOUND ATTENUATING STRUCTURE

[75] Inventor: Robert H. Murdock, Kensington, Calif.

[73] Assignee: Custom Automatic, Richmond, Calif.

[21] Appl. No.: 454,689

[22] Filed: Mar. 25, 1974

[51] Int. Cl.[2] ..... E04H 17/16

[52] U.S. Cl. ..... 256/24

[58] Field of Search ..... 256/19, 24, 25, 26; 52/568, 580, 581, 582; 181/33 G, 33 GB

[56] References Cited

U.S. PATENT DOCUMENTS

| | | | |
|---|---|---|---|
| 830,437 | 9/1906 | Humphrey | 256/24 |
| 3,034,610 | 5/1962 | Lynch | 256/25 |
| 3,120,376 | 2/1964 | Case | 256/24 |
| 3,783,968 | 1/1974 | Derry | 256/24 |

*Primary Examiner*—Doris L. Troutman

*Attorney, Agent, or Firm*—Harris Zimmerman

[57] ABSTRACT

A wall for attenuating highway noise and the like comprises spaced apart posts set generally perpendicular to the ground slope, and panel sections secured therebetween. Each post includes a T-channel member with an elongated locking plate removably secured to the edge of the web of the T-channel and disposed normal thereto. Between the locking plate and each branch of the T-channel a panel jamb is resiliently secure, and one end of a pre-assembled panel is joined to each jamb. In one embodiment the panels are constructed of double-walled courses supported by horizontal joists which are joined to the jamb. In another embodiment the panels are formed of courses of parallel right-angle members resiliently locked into vertically spaced slotted bars, with acoustic insulation secured between the right-angle members.

15 Claims, 8 Drawing Figures

SOUND ATTENUATING STRUCTURE

BACKGROUND OF THE INVENTION

In localities where highways or freeways adjoin residential districts or business areas, schools or hospitals, the road noise is often objectionable to the point of being intolerable to the individuals living and working in those areas. A busy freeway can generate approximately 80 dB of noise at a distance of 100 feet from the roadway if the traffic includes diesel trucks, with variations from 74 dB to 86 dB. Studies show that the average diesel truck at a distance of 25 feet, emits approximately 92 dB of noise, with some ranging as high as 105 dB. This noise varies in frequency from 60 Hz to 8 KHz, the screech of the brakes. The noise level and its frequent components are a function of the type of pavement, the type and speed of traffic, the presence of a grade, and whether the roadway is sunken, flat or elevated.

For those individuals in the vicinity of a highway, a road noise level of 65–70 dB is generally acceptable. If the noise level falls in the 70–80 dB range, complaints will be heard. At 90 dB, the road noise threatens to cause hearing damage. Since a highway is a line source of noise, the natural attenuation due to transmission loss through the air is −3 dB as the distance from the roadway doubles. Thus a truck which creates 92 dB of noise at a distance of 25 feet will cause an intolerable level of perceived noise of 80 dB at a distance of 400 feet. Obviously a great distance must separate an observer from a highway if the noise perceived by the observer is to be made tolerable through natural transmission loss.

Clearly there is a need for a noise attenuating structure to separate highways and freeways from adjoining dwellings. One such structure which is commonly used is an earth berm planted with grass, flowers, trees and shrubs. Although such an earth berm is aesthetically pleasing, it typically requires 32 feet of additional right-of-way for the road, plus 5 cubic yards of fill material per linear foot. In addition the plantings must be watered and maintained. An earth berm cannot be used along an elevated roadway, nor in an urban area where a narrow right-of-way is an economic necessity. Other structures similar in nature but fabricated of wood, stone, brick, concrete or the like have similar drawbacks and limitations.

SUMMARY OF THE INVENTION

The present invention provides a sound attenuating barrier which protects and insulates neighborhoods adjoining highways from intolerable road noise. It presents a pleasing appearance to the eye, it is easily installed and maintained, and it has a very low sound transmission coefficient. Generally, the barrier includes spaced apart support posts with pre-assembled panel sections secured therebetween. Each post comprises a vertically disposed T-channel member set in a concrete footing, bolted to an overpass or bridge structure, or similarly anchored. A vertically extending locking plate is removably secured to the web edge of the T-channel with screws or bolts. A vertical panel jamb is compressively retained between the locking plate and each flange of the T-channel, with a spacing between the jamb and the web adjustable during construction to accommodate terrain contours.

Each panel is secured at each end to a panel jamb. In one embodiment the panel is constructed of horizontal aluminum bars with opposed right-angle aluminum panel members resiliently engaging a bar at the upper and lower edges. Between the opposed panel members a sheet of acoustic insulation is secured to prevent noise transmission. The panel members facing the highway are provided with a matrix of small holes therethrough to reduce the reflection of high frequency noise components.

In another embodiment the panels are formed of horizontal panel members, each member comprising opposed insulating walls with a dead air space therebetween. The panel members are stacked in courses, with horizontal studs joining adjacent panel members and screwed to the panel jamb. The double wall construction provides greater noise reduction. In both embodiments the panel members may be anodized or painted in ambient color patterns to provide a pleasing, unobtrusive appearance.

THE DRAWING

DESCRIPTION OF THE PREFERRED EMBODIMENT

Figure 4:
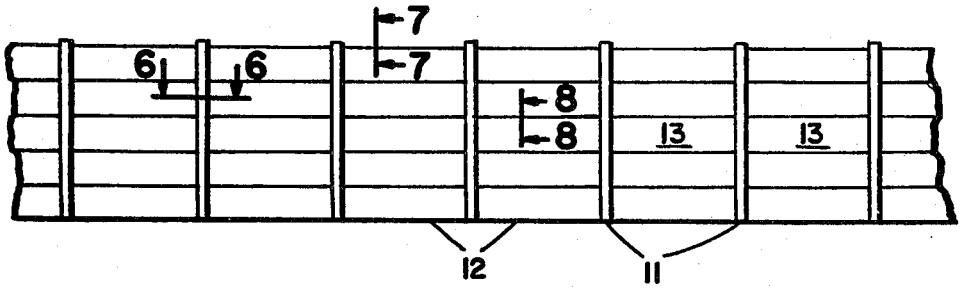
FIG. 4 is an elevation of a further embodiment of the present invention.

As shown in FIG. 4, one embodiment of the present invention generally comprises a plurality of vertical support posts 11 spaced apart and anchored in footings or secured to the frame structure of a bridge or overpass. Between the posts are secured pre-assembled panels 12 which consist of courses of horizontal panel members 13 joined together in vertical relationship. The wall thus formed may be installed section-by-section to any length required, and, by supplying an appropriate number of courses in each panel and suitably high posts, the height of the wall may be selected and varied to suit the surrounding terrain.

Figure 6:
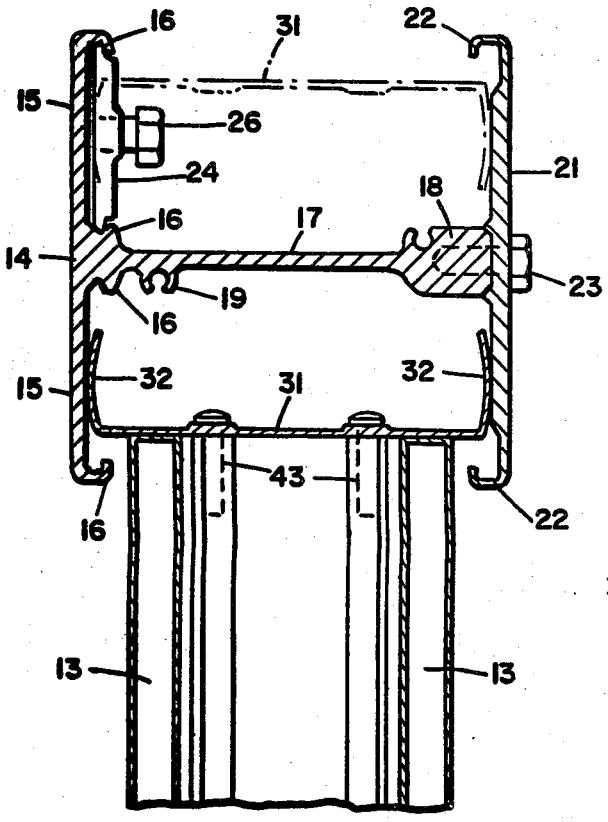
FIG. 6 is a cross-sectional top view of a portion of the invention, taken along line 6—6 of FIG. 4.

Each post 11 includes a vertical T-channel member 14, preferably fabricated of aluminum. As shown in FIG. 6, the member 14 includes reentrant edges 16 extending along the flanges 15, and a web 17 which is provided with spaced apart threaded holes 18 in the edge thereof. The web is also furnished with vertically extending truncated tubes 19 which add structural rigidity to the web and allow a cap to be affixed to the post, as shall be explained in the following.

The post is also provided with a vertically disposed locking plate 21 which includes reentrant edges 22 extending along the vertical extremities thereof. The locking plate is removably secured to the channel member 14 by means of machine bolts 23 received through appropriately spaced holes in the locking plate and threaded into the holes 18. Also disposed in the post are two adjustable support plates 24 (one shown) which are received between the reentrant edges 16 abutting the flanges 15. The plates 24 are provided with tensioning screws 26 to permit the plate to be positioned supporting a panel section and secured in place.

Figure 5:
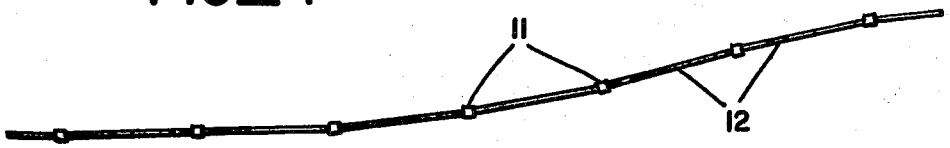
FIG. 5 is a top view of the embodiment depicted in FIG. 4.

Between each flange of the T-channel member and the locking plate a jamb 31 is secured. The vertically disposed jamb extends the full height of the panel 12, and is provided with resilient sides 32 which are compressively restrained between the locking plate and the channel flange. It should be noted that the jamb is adjustably disposed within the post, and during installation it may be canted vertically or horizontally according to terrain contours (as depicted in FIG. 5), and may be adjustably spaced apart from the web 17. This quality permits the panels to fit into adjacent posts which are anchored off centers, and to undergo thermal expansion and contraction in a 150° F. ambient temperature range without causing any warping or stress in the wall. Also, the resilient tension in the jamb reduces the amount of noise transmitted therethrough.

Figure 7:
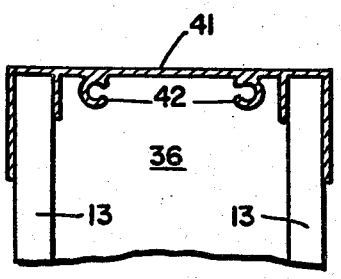
FIG. 7 is a cross-sectional side view of a portion of the further embodiment, taken along line 7—7 of FIG. 4.
Figure 8:
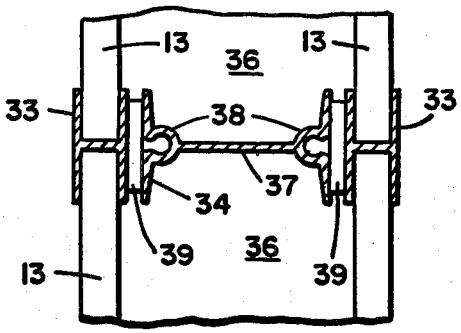
FIG. 8 is a cross-sectional side view of the further embodiment taken along line 8—8 of FIG. 4.

Each panel 12 is composed of vertically arrayed courses of horizontal panel members 13. These panel memrs may be gypsum sheet or fire sheathing or the like, and may be laminated exteriorly with exterior grade polyvinyl wall covering. As depicted in FIGS. 7 and 8, the panel members are arrayed in opposed pairs, each pair supported by a flanged rail 33, and together defining a dead air cavity 36. Each horizontal stud 34 includes a web 37 integrally joined at either end to an omega channel 38. Interposed between the flanged portions 33 and the channel 38 is a double-faced adhesive strip of sound absorbing material 38, which prevents noise transmission through the wall and joins the flanged rails to the stud. This absorbing material, in conjunction with the double wall of panels 13 and the dead air space, provides a wall with an extremely low sound transmission coefficient. At the upper extremity the wall is sealed by a horizontal trim member 41, which is strengthened by truncated tubes 42.

The panel jamb is furnished with pairs of holes vertically spaced apart and disposed to register with the apertures of the omega channel portions and the truncated tubes 42. Machine screws 43 are received through these holes and threadedly secured in the apertures, thereby joining the panel jamb to the horizontal studs and maintaining the integrity of the panel 12.

To erect the sound attenuating wall of the present invention, the posts are first anchored in predetermined, evenly spaced apart relationship. The locking plates are then loosedly secured to the posts with the bolts 23, and the support plates are positioned and secured to set the height of the lower edge of each panel section 12. The panel sections 12, each consisting of two panel jambs with courses of panel members 13 and horizontal studs 34 pre-assembled into a unit, are lowered from above so that each jamb slides down into adjacent posts between the loose locking plate and the post flange. The locking plates are then tightened, compressing the jambs and securing the panel in the posts.

Figure 1:
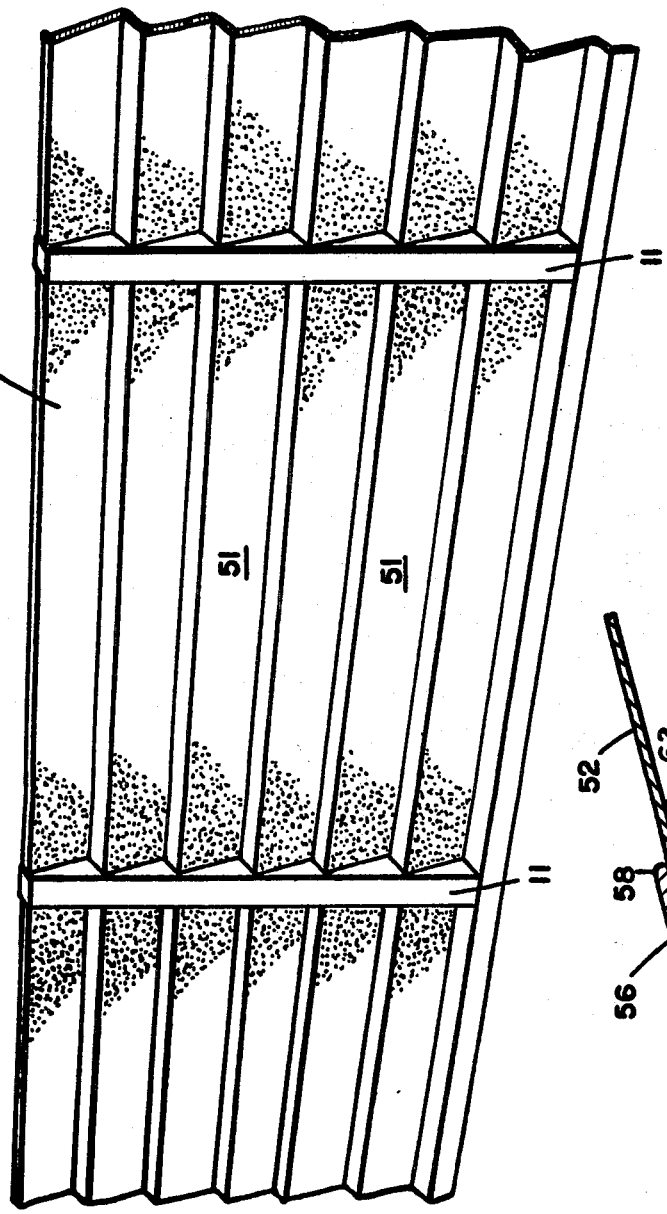
FIG. 1 is a perspective view of one embodiment of the present invention.

Another embodiment of the invention employs the same novel post, panel jamb and locking plate design, with a novel panel system. As shown in FIG. 1, each panel section 12 is composed of panel members 51 which present a surface toward the highway which is inclined downwardly from vertical. This feature allows light to be reflected downward toward the road, reducing glare for the motorists. Also the staggered panel effect causes many components of road noise to be reflected in patterns of destructive interference, thereby reducing noise levels.

Figure 2:
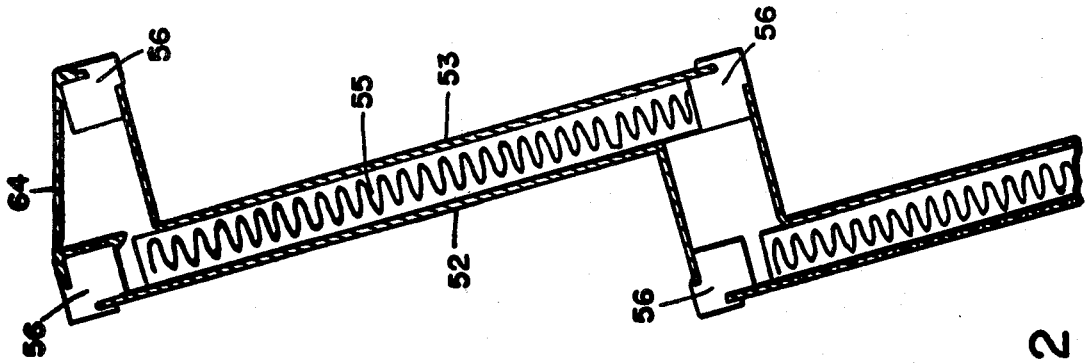
FIG. 2 is an enlarged cross-section of a portion of the embodiment shown in FIG. 1.

Each panel member 51 includes two laterally extending right-angle blades 52 and 53, with the long legs of each opposed and parallel, and the short legs diverging, as shown in FIG. 2. The blade 52 facing the roadway is provided with a matrix of holes formed therein to permit absorption of high frequency noise components. A sheet of sound absorbing material 55 such as fiberglass or acoustical planking is compressively secured between the blades 52 & 53 to attenuate sound passing through the wall.

Figure 3:
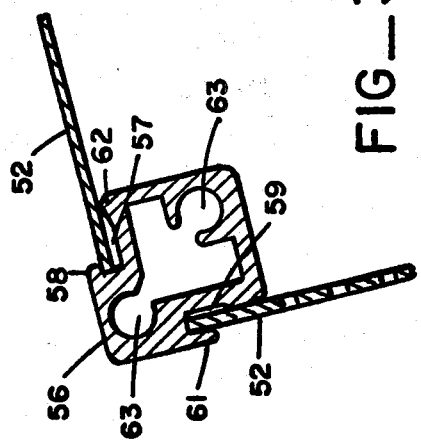
FIG. 3 is an enlarged cross-section of a portion of the embodiment shown in FIG. 1.

The upper and lower edges of each blade are resiliently retained in the slots of a horizontal bar 56, as depicted in FIG. 3. The downwardly extending slot 59 is furnished with a flange 61 to engage a substantial portion of the edge of the blade. The laterally extending slot 57 includes a lateral shoulder 58 for engaging the edge of the blade, and another shoulder 62 for resiliently urging the blade to engage shoulder 58. The interior cavity of the bar 56 is provided with truncated tubes 63 for increased rigidity, and for receiving panel jamb screws 43 as required. The completed panel section requires no mechanical link from one side to the other, so that there is no direct sound transmission path through the wall. The top and bottom of each panel is capped with a horizontally extending end extrusion 64.

The blades of the present embodiment may be formed of anodized aluminum, or may be provided with permanent color finishes. Where desirable, each panel section may include blades of various colors in pleasing patterns, such as dark green at the bottom of the panel changing to light blue at the top of the panel. Color photographs of the right of way may be used to determine the effect desired. Also the staggered blades present an attractive shadow box effect of light and shade.

Although either embodiment of the present invention is designed to be maintenance-free under normal conditions, it must be recognized that roadside structures are subject to damage by automobiles running out of control. Due to the fact that the present invention may easily be standardized to common post heights, panel member widths and heights, and the like, damaged sound wall sections will be replaced quickly and cheaply. More importantly, the invention, due to its aluminum construction and resilient joining, will absorb a great amount of energy during an impact. As opposed to steel, concrete or masonry structures, the sound wall disclosed herein, with its lesser mass and greater elasticity, will lessen initial impact damage to the vehicle and will decrease the chance of serious injury to the vehicle occupants.

In summarizing the advantages of the present invention, it should be noted that it:

provides high noise attenuation;

presents no drainage problems such as occasioned by solid walls on continuous footings;

provides automatic adjustment to curves and changes in height;

permits full thermal expansion and contraction;

may be adapted to parapet or side mounting;

provides resilient, strong construction which is maintenance free; and uses standardized parts to form panels which can quickly be replaced without affecting adjacent panels.

I claim:

1. A wall construction comprising spaced apart vertical support means, a plurality of panel sections each extending between adjacent vertical support means, each of said panel sections including a vertically disposed panel jamb at each end thereof, locking means including plate means adjustably spaced from and secured to each of said vertical support means for resiliently and compressively engaging therebetween each of said panel jambs, each of said panel sections including a plurality of laterally disposed panel members vertically stacked in courses extending between a pair of said panel jambs, and each of said courses including a pair of horizontally extending vertical sheets, said pair of sheets being parallel and spaced apart.

2. The wall construction of claim 1, wherein said vertical support means comprises a plurality of vertical support posts.

3. The wall construction of claim 2, wherein each of said support posts comprises a T-channel member having a channel web and flanges extending from one edge thereof and normal thereto.

4. The wall construction of claim 3 wherein said locking means comprises a vertically disposed plate removably joined to said web of said T-channel member.

5. The wall construction of claim 4, wherein said panel jamb includes resilient sides for engaging said locking plate and one of said T-channel flanges.

6. The wall construction of claim 2 further including adjustable support means secured to each of said posts for supporting the lower end of each of said panel sections.

7. The wall construction of claim 6, further including a plurality of horizontal studs, each of said studs interposed between and supporting objacent courses.

8. The wall construction of claim 7, wherein each of said studs is secured at each end thereof to one of said panel jambs.

9. A wall construction comprising spaced apart vertical support means a plurality of panel sections each extending between adjacent vertical support means, each of said panel sections including a vertically disposed panel jamb at each end thereof, locking means including plate means adjustably spaced from and secured to each of said vertical support means for resiliently and compressively engaging therebetween each of said panel jambs, each of said panel sections including a plurality of laterally disposed panel members vertically stacked in courses extending between a pair of said panel jambs, and wherein each of said courses comprises a pair of laterally extending right angle blades.

10. The wall construction of claim 9, wherein each of said right angle blades comprises a pair of laterally extending webs each normal to the other and joined at respective lateral edges.

11. The wall construction of claim 10, wherein said pair of blades are disposed with one web of each opposed and parallel, the other web of each parallel and diverging.

12. The wall construction of claim 11, including insulating means secured between said opposed and parallel webs.

13. The wall construction of claim 9, further including a plurality of horizontal bars, each of said bars joining objacent courses and interposed therebetween.

14. The wall construction of claim 13, wherein each of said bars includes a pair of slots for resiliently engaging the lower edge of a superjacent blade and the upper edge of a subjacent blade.

15. The wall construction of claim 13, wherein each of said bars is joined at each end of one of said panel jambs.

* * * * *